United States Patent [19]

Bowman et al.

[11] 4,219,868

[45] Aug. 26, 1980

[54] PLUG-IN LIGHTING SYSTEM

[75] Inventors: Robert W. Bowman; Raymond A. Brown, both of Crawfordsville, Ind.

[73] Assignee: National Service Industries, Inc., Atlanta, Ga.

[21] Appl. No.: 910,846

[22] Filed: May 30, 1978

[51] Int. Cl.[2] ..... F21S 1/02; F21S 1/04

[52] U.S. Cl. ..... 362/147; 52/28; 339/75 M; 339/119 L; 362/404

[58] Field of Search ..... 362/147, 404, 405, 406, 362/217, 219, 220, 221; 315/185 R, 189, 191; 307/157; 339/119 R, 119 L, 121, 75 M, 122 F, 135; 174/49, 59, 60; 52/28

[56] References Cited

U.S. PATENT DOCUMENTS

| | | | |
|---|---|---|---|
| 2,847,561 | 8/1958 | Huerkamp | 362/220 |
| 2,907,872 | 10/1959 | Wilson | 362/220 |
| 4,001,571 | 1/1977 | Martin | 362/147 |

*Primary Examiner*—Samuel W. Engle
*Assistant Examiner*—Donald P. Walsh
*Attorney, Agent, or Firm*—Oliver E. Todd, Jr.

[57] ABSTRACT

A device for mounting and supplying electrical power to a luminaire. The device includes two connectors mounted on opposite sides of a housing which is mounted on the luminaire. The connectors on the device are wired to electrically interconnect two cables and a lighting circuit in the luminaire. Power is applied from one cable through the device to the luminaire and to the other cable which supplies power to another luminaire. A bracket on the top of the housing for mounting the luminaire in a building structure is adjustable in a direction extending linearly between the connectors to compensate for fixture balance and the weight of the cables connected to the device.

5 Claims, 8 Drawing Figures

PLUG-IN LIGHTING SYSTEM

BACKGROUND OF THE INVENTION

This invention relates to electrical lighting systems and more particularly to an improved device for mounting and supplying electrical power to luminaires such as indoor industrial lighting fixtures of the type using high intensity discharge lamps.

Interior industrial lighting is often provided with luminaires containing high intensity discharge (HID) lamps, such as mercury lamps, metal halide lamps or high pressure sodium lamps. Luminaires of this type typically consist of a ballast housing containing a ballast circuit for energizing the lamp and a downwardly directed reflector mounted on the ballast housing. One typical method for installing lighting fixtures of this type is to attach the ballast housing to a junction box which is in turn anchored to a building structure. Wiring within the junction box is then permanently connected to the ballast circuit for supplying power to the lamp. The junction box is mounted, for example, by a rod or pendent having an upper end anchored to the building structure and a lower end which threadably engages the junction box. Or, the junction box can be attached directly with bolts to the building structure or to an I beam or other member within the building. Problems occur with a luminaire installation of this type when it is necessary to change the location of the luminaires or to remove a luminaire, for example, for repair or maintenance. Power is typically supplied in a hard wired branch circuit which connects from fixture junction box to fixture junction box for a number of luminaires. When one of the luminaires in the circuit is to be disconnected, the wiring must be changed manually by an electrician. The wiring also must be changed manually when it is necessary to change switching for selected ones of a number of luminaires in a circuit or to relocate one or more luminaires as lighting requirements change. Since the circuit is permanently connected from fixture to fixture, considerable difficulty and expense is encountered in modifying the circuit connections to selected fixtures.

U.S. Pat. No. 4,001,571, for example, discloses a relocatable lighting system in which power is supplied to a plurality of lighting fixtures through a branch circuit. The branch circuit is formed by branch circuit cables which connect from fixture to fixture. Any fixture can be disconnected from the circuit without removing power from the circuit. However, the system of this patent does not deal with problems relating to both mounting and supplying power to industrial luminaires in a relocatable system.

Luminaires for high intensity discharge lamps often are designed to illuminate the largest possible area without providing high angle glare. High angle glare occurs when the lamp is located within the normal field of vision of a person standing below and to one side of the luminaire. When the luminaire is designed for illuminating a maximum work area, it is important that the luminaire be mounted with a vertical orientation. If the luminaire is inclined by only a small amount, such as about 5°, undesirable high angle glare may occur. This inclination will also interrupt the total uniformity of the lighting layout in a work area beneath the luminaire.

SUMMARY OF THE INVENTION

According to the present invention, an improved device is provided for both mounting and supplying electrical power to an industrial luminaire in a lighting system. The device facilitates relocating either the luminaire or circuits connected to specific luminaires, for example, when it is necessary to change switching or wiring connections to only a few luminaires in a circuit.

The device of the present invention includes two electrical connectors mounted in a housing. The connectors on the device are wired to interconnect two branch circuit cables and a lighting circuit in a luminaire mounted on the device. Power is applied through one cable and one connector both to the luminaire and, through the second connector, to the other cable which in turn connects to a similar device which mounts the next luminaire in the circuit. The two connectors are mounted on opposite sides of a vertical axis which extends through the luminaire and the attached device. The location of a bracket on the top of the housing for mounting the device to a building structure is adjustable in a linear direction between the connectors to compensate for fixture imbalance and for the weight of the cables engaging the connectors. This permits accurate vertical alignment of the luminaire after it is mounted.

Accordingly, it is an object of the invention to provide an improved device for mounting and supplying electrical power to lighting fixtures.

Another object of the invention is to provide an improved relocatable lighting system using a novel device for mounting and supplying electrical power to a luminaire connected in circuit with a plurality of luminaires.

Still another object of the invention is to provide an improved device for mounting and supplying electrical power to a luminaire which facilitates modification of the wiring to the luminaire and to other luminaires connected in the same circuit.

Other objects and advantages of the invention will become apparent from the following detailed description, with reference being made to the accompanying drawings.

DESCRIPTION OF THE PREFERRED EMBODIMENT

Figure 1:
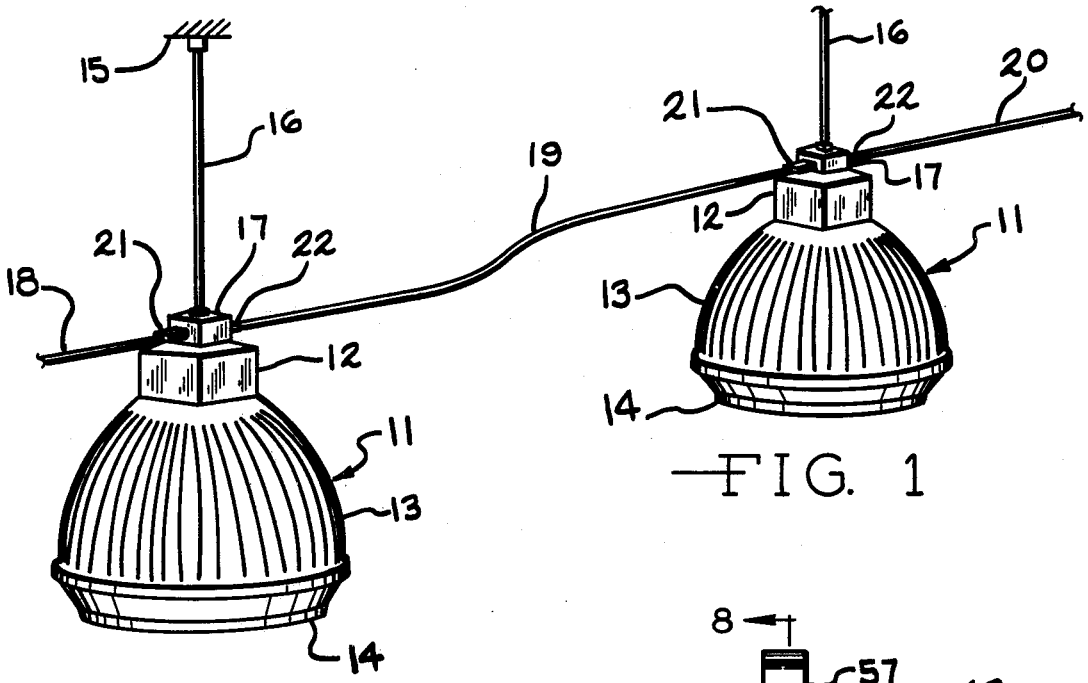
FIG. 1 is a fragmentary perspective view of a lighting system showing two luminaires, each connected in an electrical circuit and mounted from a building structure with a device constructed in accordance with the present invention.

Turning now to the drawings and particularly to FIG. 1, a fragmentary portion of a relocatable plug-in lighting system 10 is shown. The lighting system 10 includes a plurality of luminaires 11 (only two shown) which are illustrated as a type including a ballast housing 12, a reflector 13 and a refractor 14. The ballast housing 12 encloses a ballast circuit for operating an HID lamp (not shown) such as a mercury lamp, a metal halide lamp or a high pressure sodium lamp. The lamp is mounted within the reflector 13 which directs light from the lamp downwardly through the refractor 14 to illuminate a work area.

The luminaires 11 are mounted in a building structure to illuminate an area. A fragmentary portion of a building roof or ceiling structure 15 is illustrated with a separate pendent, rod or stem 16 attached to the ceiling structure 15 for each of the luminaires 11. A separate device 17 in accordance with the present invention is attached to each pendent 16. Each device 17 mounts one of the luminaires 11 and also establishes electrical connection to such mounted luminaire 11. The fragmentary portion of the lighting system 10 shown in FIG. 1 has three cables 18, 19 and 20 with the cables 18 and 20 shown in fragmentary. The cables 18–20 are identical and are provided with input and output connectors 21 and 22, respectively, at the cable ends. The input connector 21 on the cable 18 is connected to supply power to the device 17 for one of the luminaires 11 and the other end of the cable 18 is connected to a source of electrical power (not shown) such as an upstream device 17 for another luminaire or a power distribution junction box. The output connector 22 and the input connector 21 on the cable 19 are connected between two devices 17 for mounting two separate luminaires 11. The output connector 22 on the cable 19 receives power from an output of the upstream device 17 while the input connector 21 on the cable 19 supplies power to an input to the device 17 mounting the next downstream luminaire 11. The cable 20 receives power from the device 17 for such luminaire and supplies this power to a downstream luminaire (not shown). It should be noted that power connections are maintained through each of the devices 17 between the two cables and the luminaire 11 connected to the device, such as between the cables 18 and 19 and a mounted luminaire 11 or between the cables 19 and 20 and a mounted luminaire 11. Since power is distributed to the different luminaires 11 through cables terminating in identical connectors 21 and 22, the cables may be relocated for changing lighting requirements.

Figure 2:
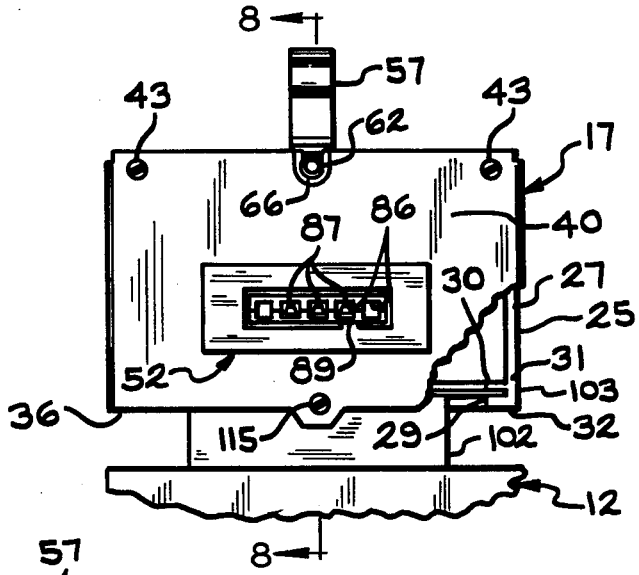
FIG. 2 is a fragmentary end elevational view of the device of the present invention for mounting and supplying electrical power to a luminaire.
Figure 3:
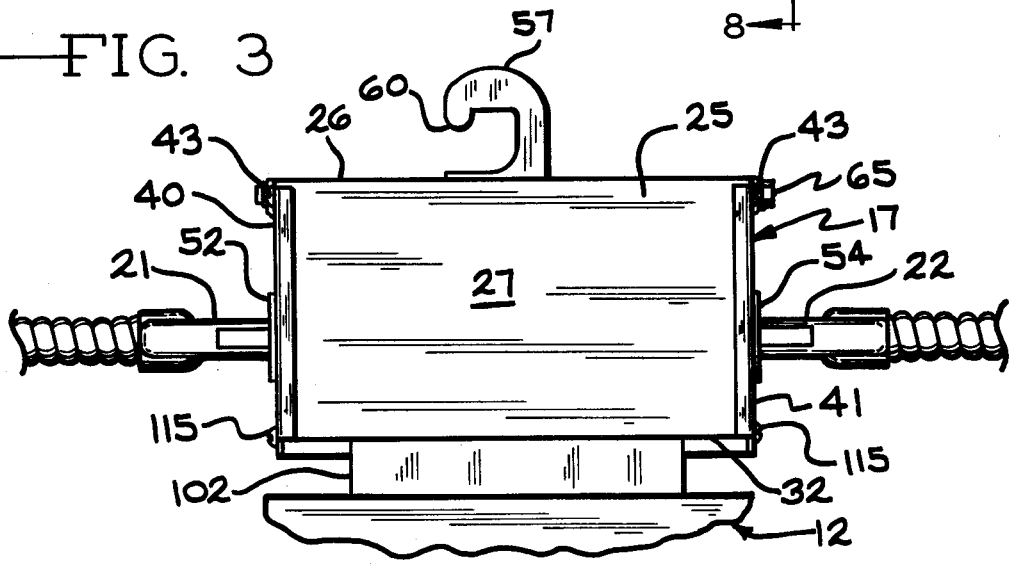
FIG. 3 is a fragmentary side elevational view of the device of the present invention for mounting and supplying electrical power to a luminaire.
Figures 4, 5, 6:
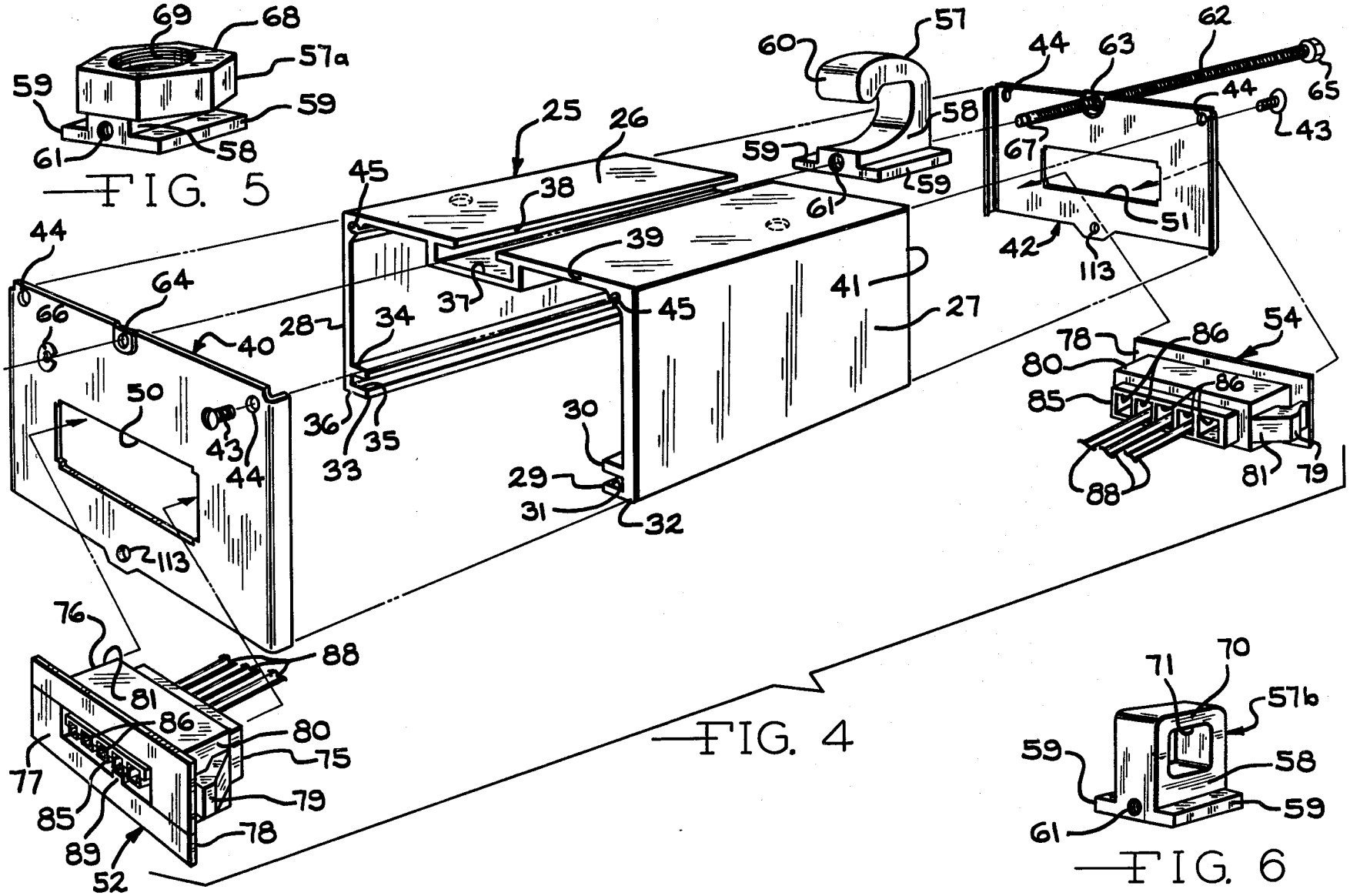
FIG. 4 is an exploded perspective view of the device of the present invention for mounting and supplying electrical power to a luminaire and provided with a hook bracket for attaching the device to a building structure.
FIG. 5 is a perspective view of a threaded bracket for use with the device of FIG. 4.
FIG. 6 is a perspective view of a loop bracket for use with the device of FIG. 4.

Turning now to FIGS. 2-4, details are shown for the device 17 for mounting and supplying electrical power to the luminaires 11. The device 17 has an outer housing 25 which, preferably, is extruded from an aluminum alloy or a similar material. The outer housing 25 has a generally C-shaped cross section defined by a top 26 and two depending sides 27 and 28. The side 27 has two inwardly directed flanges 29 and 30 defining a groove 31 along a lower edge 32 and the side 28 has two inwardly directed flanges 33 and 34 defining a groove 35 extending along a lower edge 36. The grooves 31 and 35 are parallel and open toward each other. A channel 37 having an upwardly directed opening 38 extends along the length of, and is centered on, the housing top 26. An open end 39 on the outer housing 25 is closed by a cover plate 40 and a second open end 41 on the outer housing 25 is closed by a cover plate 42. The cover plates 40 and 42 are attached to the outer housing 25 by means of screws 43 passed through holes 44 in the cover plates 40 and 42 and threaded into aligned holes 45 in the outer housing 25.

The cover plates 40 and 42 are provided with rectangular openings 50 and 51, respectively. An input connector 52 is mounted in the opening 50 in the cover plate 40 and an output connector 54 is mounted in the opening 51 on the cover plate 42. The connectors 52 and 54 are designed for receiving the input and output connectors 21 and and 22, respectively, on the cables 18–20 or on similar cables supplying power in the lighting system 10 of FIG. 1.

A mounting bracket 57 is retained in the channel 37 on the outer housing 25. The mounting bracket 57 includes a central member 58 which passes through the opening or slot 38 in the outer housing top 26 and opposing, outwardly directed flanges 59 which are received by the channel 37 but will not pass through the opening or slot 38. An upper portion 60 of the mounting bracket 57 is in the shape of a hook for attaching the device 17 to a mating member (not shown) located in a building structure. The mating member, for example, may be in the form of a loop attached to the bottom of a conduit or rod depending from a ceiling in the building structure. The bracket 57 also includes a threaded opening 61 which extends in a direction parallel to the slot or opening 38 in the outer housing top 26. A travel screw 62 extends through an opening 63 in the cover plate 42, threadably engages the opening 61 in the bracket 57 and extends through an opening 64 in the cover plate 40. The travel screw 62 is retained by an integral head 65 which abuts the cover plate 42 and a C-shaped retainer 66 which engages a groove 67 in the travel screw 62 and abuts the cover plate 40. By rotating the screw 62, the bracket 57 either is centered in the channel 37 or is positioned towards one of the connectors 52 or 54. The location of the bracket 57 in the channel 37 is adjusted linearly between the connectors 52 and 54 to compensate for imbalances on the device 17 from an attached luminaire 11 and from different length cables attached to the connectors 52 and 54 to orient the luminaire 11 on a vertical axis.

The bracket 57 may be modified to provide any desired means for attaching the device 17 to a building structure. FIG. 5 shows a modified mounting bracket 57*a* which again has the central member 58, the flanges 59 and the threaded opening 61. However, the upper portion or hook 60 of the bracket 57 has been replaced in the bracket 57*a* with a nut 68 having a threaded opening 69 for engaging a threaded end of a rod, stem or pendent, such as the rods 16 shown in FIG. 1. A further modified mounting bracket 57*b* is shown in FIG. 6 in which the upper portion 60 of the bracket 57 has been replaced with a closed loop 70 which defines an opening 71. A hook or a heavy gauge wire support may be passed through the opening 71 for attaching the bracket 57*b* to a building structure. Again, the bracket 57*b* also includes the central member 58, the flanges 59 and the threaded opening 61 as in the mounting bracket 57.

Figure 8:
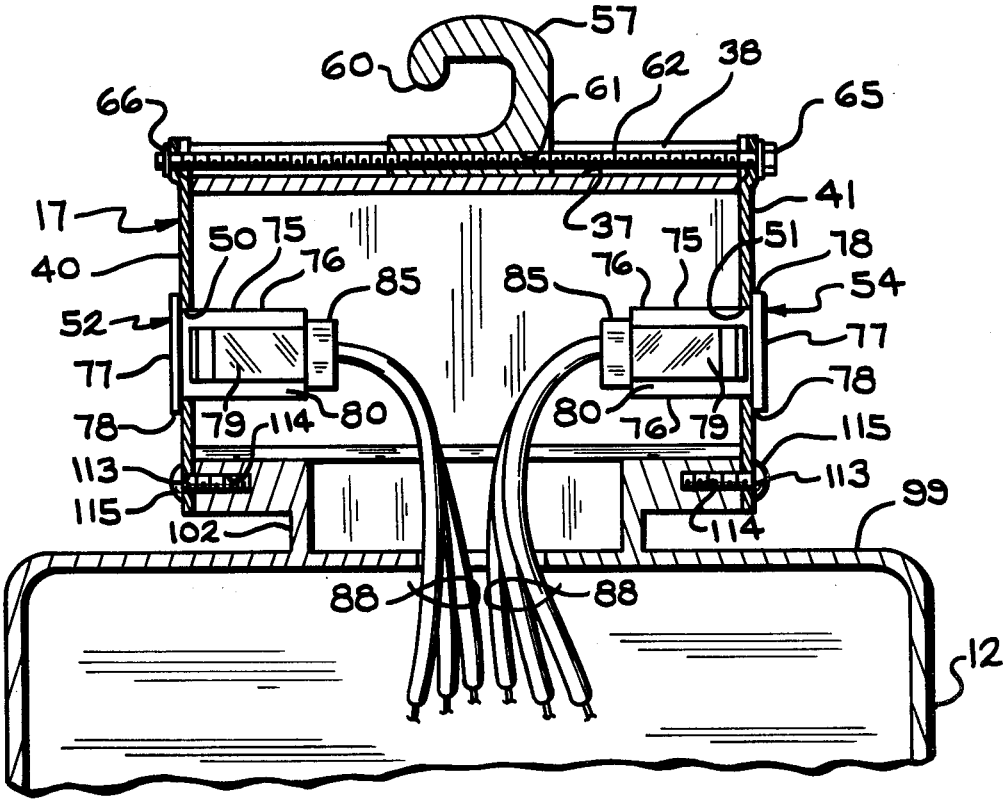
FIG. 8 is a cross sectional view taken along line 8—8 of FIG. 2.

Details for the connectors 52 and 54 are shown in FIGS. 2, 4 and 8. The connectors 52 and 54 may be identical and the same reference numbers will be applied to like parts on the two connectors 52 and 54. The connectors 52 and 54 each have a housing 75 which may be molded from a synthetic resinous material or from any other suitable material. The housing 75 has a main body portion 76 of a size and shape for passing through the openings 50 and 51 in the end plates 40 and 42, respectively. An outer surface 77 on the housing 75 defines a flange 78 extending around the housing 75 and having a dimension greater than the plate opening 50 and 51. Two resilient clips 79 are formed on opposite ends 80 and 81 of the housing body 76. The resilient clips 79 deflect when the connectors 52 and 54 are inserted into the plate openings 50 and 51, respectively. When the connectors 52 and 54 are firmly seated within their respective openings 50 and 51 with the flange 78 abutting the plates 40 and 42, the resilient clips 79 firmly engage the plates 40 and 42 to lock the connectors 52 and 54 in place.

An insulator 85 is positioned within the housing 75. The insulator 85 has a plurality of openings 86, of which five are shown, which extend through the insulator 85 for mounting terminals 87. Only three of the openings 86, the middle three, are illustrated as carrying the terminals 87 which are in turn connected to three wires 88 which extend from the openings 86 at the back of the connectors 52 and 54. However, it should be appreciated that the connectors 52 and 54 may carry any number of terminals and wires from one to five or more and that not necessarily all of the openings 86 in the insulator 85 may be used. A notch 89 is shown in the connector face 77 adjacent the insulator 85. The notch 89 forms a key which engages a corresponding slot in the connector 21 engaging the connector 52 and a corresponding slot in the connector 22 engaging the connector 54. It should be appreciated that the location of the key 89 may be different for the two connectors 52 and 54 so that the connector 52 will only receive the connector 21 and the connector 54 will only receive the connector 22, if desired. Also, different keying arrangements may be used in the overall lighting system 10, depending upon the voltage applied to the system 10. In other words, one keying arrangements may be adapted for use with 110 volt luminaires and another keying arrnagement may be used for 220 or 240 volt luminaires. Through the use of such a keying arrangement, the luminaires 11 will not be accidentally connected to a system having the wrong voltage.

Figure 7:
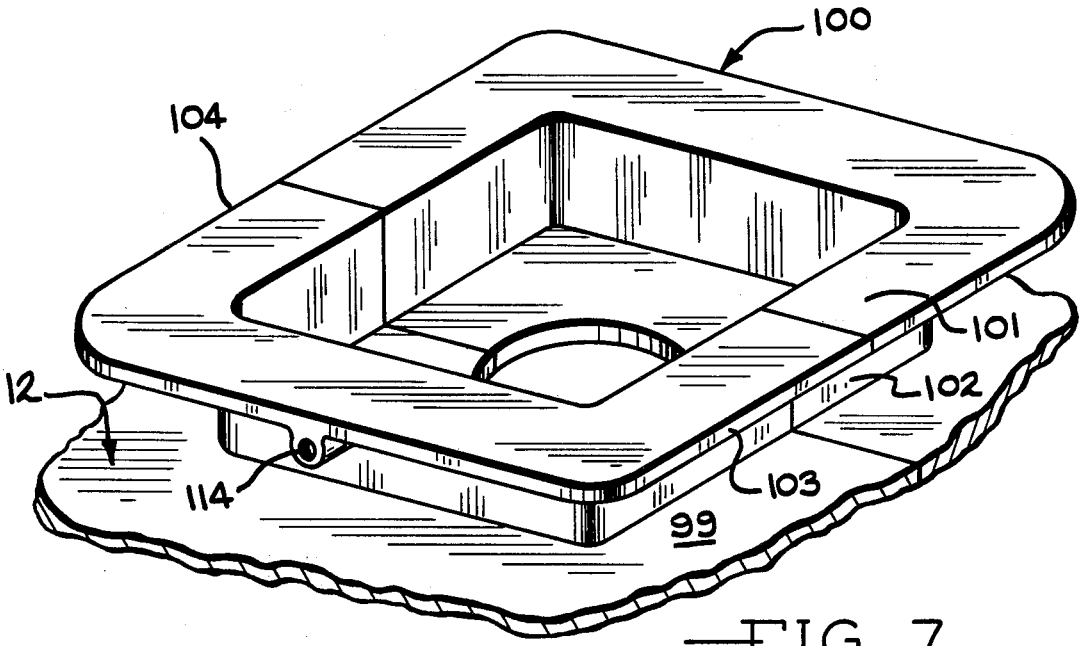
FIG. 7 is a perspective view of a mounting flange on a luminaire.

Turning now to FIG. 7, details are shown for a bracket 100 formed integrally with the top of the luminaire ballast housing 12 for engaging the device 17. The bracket 100 includes a flange 101 which extends outwardly from a member 102 projecting above a flat top 99 on the ballast housing 12. The flange 101 has opposing edges 103 and 104 which are parallel and are spaced apart to be received by the grooves 31 and 35, respectively, formed in the outer housing 25 of the device 17.

It should be noted that one of the cover plate 40 or 41 must be removed from the device 17 to insert the luminaire flange 101 into the grooves 31 and 35. The removed cover plate is reinstalled on the device 17 to retain the flange 101 within the grooves 31 and 35. The cover plate 40 includes an an opening 113 which aligns with an opening 114 in the luminaire flange 101. When the luminaire is mounted on the device 17, the openings 113 and 114 align to permit attachment of a screw 115 (see FIG. 8) to further retain the luminaire and the device 17 together. A similar screw 115 passes through a similar opening 113 in the cover plate 42 and threadably engages a second opening 114 in the flange 101.

Turning now to FIG. 8, a fragmentary cross sectional view is shown through the assembled device 17 and luminaire 11. It will be noted that when the luminaire 11 and device 17 are mechanically connected together, the wires 88 extend through an opening 90 in the ballast housing 12. The wires 88 are permanently connected to a lighting circuit in the luminaire and corresponding ones of the wires 88 from the two connectors 52 and 54 are connected together. Connectors 21 and 22 on the ends of the cables will be attached to the connectors 52 and 54 for applying power through the device 17 to the luminaire 11 and also to the next luminaire in the circuit. Since the cables may be of different lengths and exert different forces on the combined luminaire 11 and device 17, it may be necessary to adjust the position of the bracket 57 by rotating the travel screw 62. This permits orienting the luminaire 11 to direct light downwardly in a vertical direction.

The above described lighting system 10 is particularly suitable for use in portable wiring systems. Either the luminaires or the wiring or both may be relocated with minimum labor expense and without the need to manually wire the relocated circuitry. Fixtures of luminaires can be quickly and easily aligned in the field. Furthermore, the adjustable mounting bracket permits use of the device 17 with fixtures of varying sizes and weight distributions without requiring different devices 17 for the different fixtures.

It will be appreciated that various changes and modifications may be made in the above described lighting system 10 and device 17 for mounting and supplying electrical power to lighting fixtures in the system without departing from the spirit and scope of the following claims. For example, the housing 25 for the device 17 may be formed integrally with the luminaire ballast housing. In this embodiment, the connectors 52 and 54 attach to opposite sides of the ballast housing and the adjustable bracket 57 is mounted in a groove formed in the top of the ballast housing.

What we claim is:

1. A lighting system for a zone in a building structure comprising a luminaire having a socket mounting a high intensity lamp, a lighting circuit connected for energizing said lamp, reflector means at least partially surrounding said lamp for directing light downwardly in a predetermined pattern, a housing and means attaching said housing to said reflector, said luminaire having an axis about which such directed light is substantially symmetrical, a first connector mounted on said housing on one side of said axis, a second connector mounted on said housing on an opposite side of said axis, means electrically interconnecting said connectors and said lighting circuit, a first cable means engaging said first connector for supplying power through said interconnecting means to said lighting circuit and to said second connector, means attached to said housing for attaching said housing to such building structure above the zone, and means for adjusting the location of said attaching means on said housing in a linear direction between said one side and said opposite side of said axis to vertically orient said luminaire axis.

2. A lighting system for a zone in a building structure, as set forth in claim 1, and further including a second luminaire, and second cable means engaging both said second connector and said second luminaire for supplying power from said connector to said second luminaire.

3. A lighting system for a zone in a building structure, as set forth in claim 2, wherein said means connecting said housing to said reflector comprises a second housing, said second housing enclosing said lighting circuit, and further including means mounting said socket on said second housing.

4. A lighting system for a zone in a building structure, as set forth in claim 1, wherein said attaching means includes a bracket, and wherein said adjusting means includes groove means attaching said bracket to said housing for linear movement between said one side and said opposite side in a direction perpendicular to said luminaire axis, and means for positioning said bracket in said groove means.

5. A lighting system for a zone in a building structure comprising a luminaire having a socket mounting a high intensity lamp, a lighting circuit connected for energizing said lamp, reflector means at least partially surrounding said lamp for directing light downwardly in a predetermined pattern, a housing and means attaching said housing to said reflector, said luminaire having an axis about which such directed light is substantially symmetrical, at least one connector mounted on said housing to one side of said axis, means electrically interconnecting said one connector and said lighting circuit, means engaging said one connector for supplying power through said interconnecting means to said lighting circuit, means attached to said housing for attaching said housing to such building structure above the zone, and means for adjusting the location of said attaching means on said housing in a linear direction between said one side and said axis to vertically orient said luminaire axis.

* * * * *